United States Patent [19]

Rossi

[11] 4,082,499

[45] Apr. 4, 1978

[54] MULTIPURPOSE KILN SHELL GAS BURNER

[75] Inventor: Eugene F. Rossi, Wauwatosa, Wis.

[73] Assignee: Allis-Chalmers Corporation, Milwaukee, Wis.

[21] Appl. No.: 741,500

[22] Filed: Nov. 12, 1976

[51] Int. Cl.[2] ..... F27D 7/00; F27B 7/36

[52] U.S. Cl. ..... 432/19; 431/160; 431/189; 432/26; 432/105

[58] Field of Search ..... 432/19, 25, 26, 29, 432/105, 113; 431/160, 189, 279, 8

[56] References Cited

U.S. PATENT DOCUMENTS

| | | | |
|---|---|---|---|
| 824,728 | 7/1906 | Larsen | 431/8 |
| 2,107,439 | 2/1938 | Gavin | 432/105 |
| 3,185,464 | 5/1965 | Meyer et al. | 432/105 |
| 3,458,997 | 8/1969 | Clark | 431/189 |
| 3,822,110 | 7/1974 | Paredes et al. | 431/189 X |
| 3,861,859 | 1/1975 | Sherwood | 432/4 |
| 3,989,443 | 11/1976 | Campbell | 431/8 |
| 4,030,889 | 6/1977 | Gunnell | 431/189 |

*Primary Examiner*—John J. Camby
*Attorney, Agent, or Firm*—Robert C. Jones

[57] ABSTRACT

A shell gas burner is provided to preheat a kiln wherein the burner can be also used for process axial air and has provisions for retracting the burner for protection from high heat source or extending the burner for ease of replacement.

7 Claims, 5 Drawing Figures

MULTIPURPOSE KILN SHELL GAS BURNER

This invention relates to rotary kilns used for such purposes as reducing iron ore to a lower state of oxidation having provisions for axially injecting air and fuel into the kiln. In particular the invention relates to a rotary kiln wherein the same nozzle can be utilized in preheating the kiln and also used for process air. An important aspect of the invention is to provide means wherein the nozzle may be retracted from a preheat mode of operation to a protected position from heat for process air mode of operation or extended to a position for nozzle replacement. Included within the inventive concept is a flexible member which provides an important advantage in that an expansive medium is interposed between the gas tube and the air pipe.

In the prior art, rotary kilns are known which disclose various axial movable means for cleaning the nozzle. Other patents disclose in addition to cleaning means a means for cooling the nozzle tip. Such showings are made in U.S. Pat. Nos. 3,784,107 and 3,861,859. Other prior art patents such as U.S. Pat. Nos. 3,751,220; 3,861,859 and 3,946,949 disclose burner means that are arranged to provide a fluid delivery system which include means to force cooling of the nozzle. Although some of the arrangements of the prior art have had limited success in increasing service life, none have been successful in providing ease of nozzle replacement, extended nozzle life and effective preheat operation.

In many instances of large rotary furnace structures, failure in burner has been a serious problem requiring replacement on a relatively frequent basis. One of the causes of burner failures is overheating both of the burner itself and of the internal supply pipe which occurs within the hot furnace in which temperatures obtain on the order 2000° F.

It is therefore a principal object of this invention to provide means for effecting positive cooling of the burner and its associated supply pipe to thereby reduce to minimum service requirements by increasing the service life.

Another object of this invention is to provide means to retract the burner from its normal burning position when not in use to a retracted protected cool position.

Still another object of this invention is to provide means to advance the burner to a "change" position wherein servicing of the burner is facilitated.

Yet another object of this invention is to provide means for effecting the advancement or retraction of a rotary kiln internal burner exteriorly of the kiln.

SUMMARY OF THE INVENTION

In an embodiment of the invention herein set forth, a single supply pipe is arranged longitudinally within a burner shell with the terminal or burner end thereof flexible to present the burner parallel to the axis of the kiln. The assembly is movable from the exterior of the kiln to effect the movement of the burner from a burning operating position to a retracted or protected position or to an extended or servicing position. The flexibility of the supply pipe permits expansion and contraction to occur without the danger of rupturing of the assembly.

DESCRIPTION OF THE INVENTION

Figure 2:
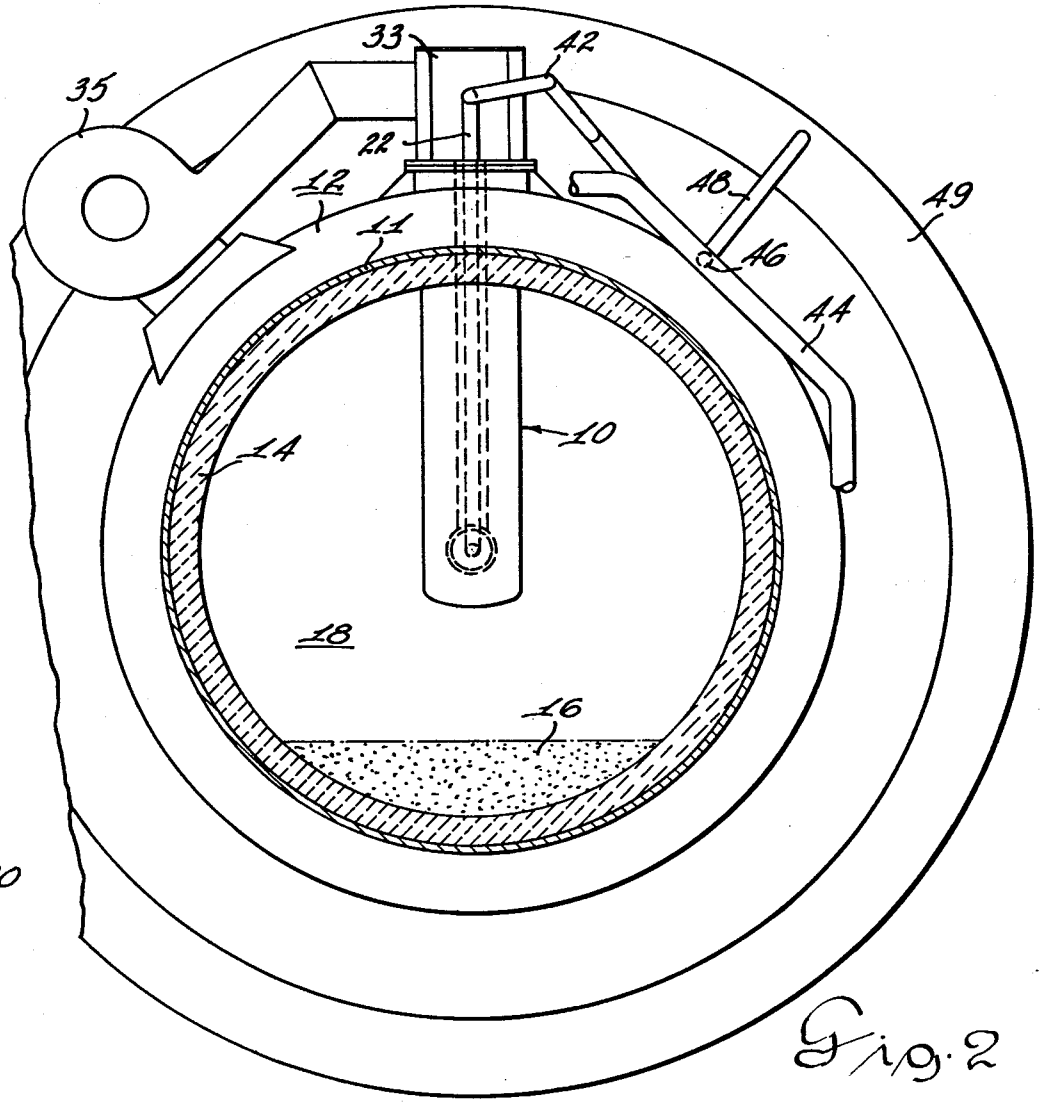
FIG. 2 is a view in cross-section taken in the plane represented by the line 2—2 in FIG. 1.
Figure 1:
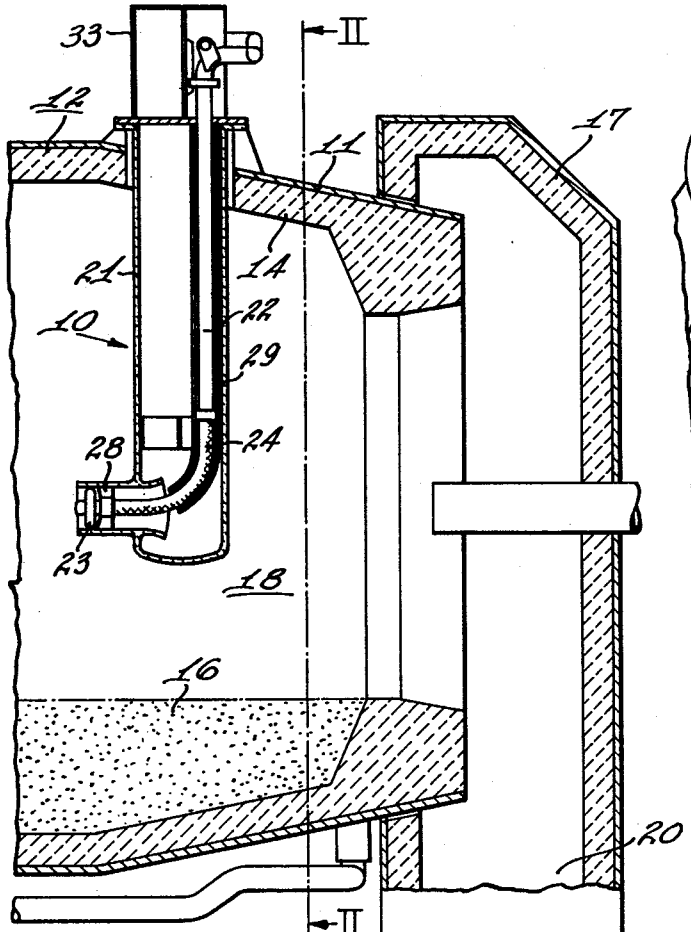
FIG. 1 is a fragmentary end view in elevation of the discharge end of a rotary kiln in which the present invention is incorporated.

Referring to the drawing, the burner assembly 10 is mounted on the outer steel shell 11 of the rotary kiln furnace 12 which is lined with a high heat resistant refractory material 14. The interior of the kiln 12 is adapted to provide passage of a bed of material 16 which is being subjected to a reduction process. A stationary hood 17 is mounted about the discharge end of kiln 12 wherein the kiln rotates relative to the hood. The material 16 within the kiln combustion chamber 18 discharges into the discharge passage 20 formed in the hood.

In rotary kilns of the type disclosed which are of extremely long length, preheating of the kiln prior to a reduction operation is necessary to bring the kiln up to operating temperature. Also, if the refractory lining 14 is replaced or repaired the refractory material requires curing. Also, additional air may be required and an axial ring burner cannot stand up to the high heat in the combustion chamber 18 when the burner is used for axial air only.

Figure 3:
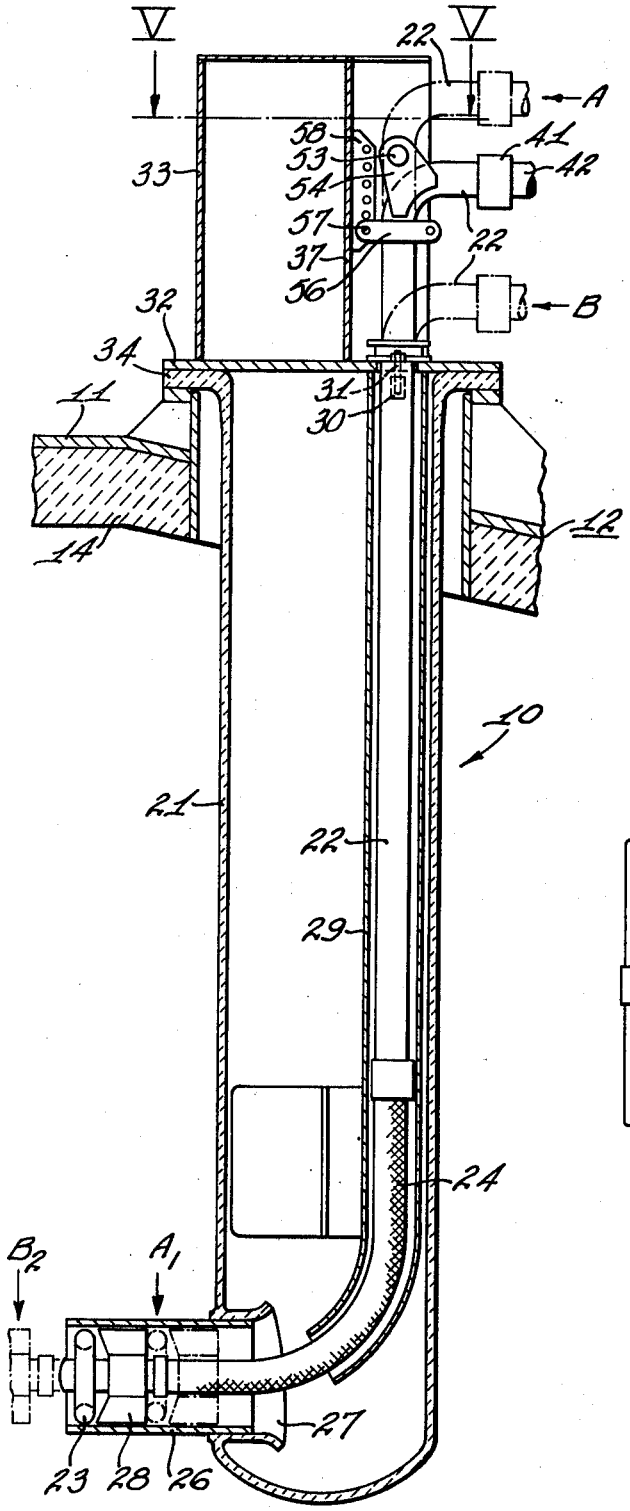
FIG. 3 is an enlarged view of the shell gas burner shown in FIG. 1.

As shown in detail in FIG. 3, the shell burner assembly 10 associated with the kiln 12 includes a shell burner pipe 21 which extends inwardly into the kiln 12 and terminates substantially on the axial line of the kiln. Within the shell pipe 21, there is movably supported a supply pipe 22 which serves to supply gas or air to a ring burner 23. As shown, the lower end of the supply pipe 22 is flexible member 24 to which the ring burner 23 is removably secured. To position the burner 23 on the axial line of the kiln 12, the flexible pipe member 24 is deflected from a vertical position to a horizontal position and extends within a nozzle extension 26. The nozzle extension 26 is supported in a horizontal plane in an inwardly flared bell mouth flow guide 27 formed at the lower end of the shell pipe 21. The ring burner 23 is supported within the nozzle 26 by means of a vaned support 28 slidably lengthwise within the nozzle 26.

Figure 5:
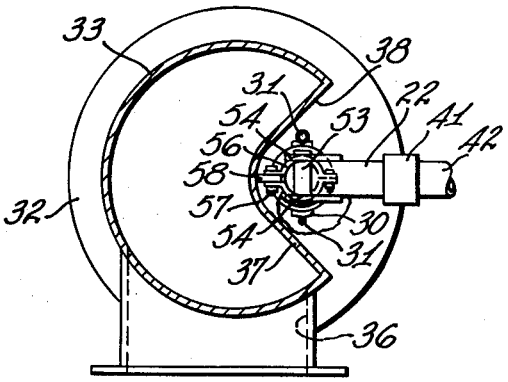
FIG. 5 is an enlarged view taken through the top manifold associated with the shell burner in a plane represented by the line 5—5 in FIG. 3.
Figure 4:
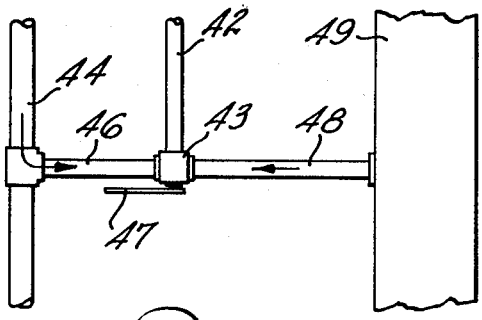
FIG. 4 is an enlarged view of the gas-air valve associated with the shell gas burner of FIG. 3.

The supply pipe 22 is supported for movement within a control pipe 29 which is supported by means of a pair of studs 31 that extend through a manifold base plate 32 attached to ear portions 30 that are welded or otherwise secured to the control pipe 29. The base plate 32 is a part of an air manifold 33 which is secured to the flange 34 portion of the shell pipe 21. An air access opening 36, FIG. 5, is provided the outer end of which receives a blower 35. As shown, the air manifold 33 is provided with a baffle wall 37 which forms a vertical passageway 38 into which the supply pipe 22 extends. The upper end of the supply pipe 22 is connected by means of a coupling 41 to a connecting pipe 42. A three-way valve 43 receives the opposite end of the pipe 42. The valve 43 is operative when in the position it occupies, as depicted in FIG. 4, to direct combustion gas from a header distribution pipe 44, via a connecting pipe 46, into the pipe 42 from whence it flows under pressure into the supply pipe 22 to be sprayed via the ring burner 23 into the combustion chamber 18. On the other hand, when the valve actuating lever 47 is displaced 180° from its position in FIG. 4, the valve is operable to interrupt gas flow from pipe 46 into pipe 42. However, in the new or 180° displaced position, the valve 43 operates to connect an air pipe 48 which is interconnected between the valve 43 and an air manifold 49 to the pipe 42 so that a flow of air is provided to the ring burner 23. The manifold 49, as shown in FIG. 2, is mounted about the exterior of kiln 12. Thus, axial combustion gas or axial air may be selectively directed to the ring burner 23.

As previously mentioned, the ring burner 23 cannot live in the high temperature environment of the combustion chamber when used for axial air only. Thus, to afford protection for the burner when it is not in normal use in the preheat mode of operation, the burner is retractable into the nozzle 26. To this purpose, the pipe 22 is bodily moved within its protecting guide pipe 29. This is done manually by means of a chain hoist (not shown) which is connected by means of a hook (not shown) to a pin 53, FIGS. 3 and 5, which extends through a pair of lugs 54 that are welded to the sides of pipe 22. A pipe clamp 56 is released by removing a bolt 57 which is engaged in one of a plurality of positioning holes formed in a vertical bracket 58. The bracket 58 is welded to the side of the air manifold baffle wall 37.

In the preheat operation, the ring burner 23 is located in the front position within the nozzle 26 as indicated in full lines in FIG. 3. In this position of the burner, the valve 43 is conditioned as indicated in FIG. 4, wherein gas from the distribution line 44 is directed to the burner 23.

When process air mode of operation is to be used, the pipe clamp 56 is released and the pipe 22 lifted to an uppermost position "A" as indicated by the broken line showing in FIG. 3. With the pipe 22 lifted to position "A" the ring burner 23 will be pulled or retracted into the nozzle 26 to the position "$A_1$" and indicated by the broken line showing in FIG. 3. The vane guide 28 serves as a slide means for the burner ring 23 and the flexible pipe end 24 in any movement effected. In the retracted position "$A_1$" of the burner 23 process air is blown from the manifold 33 down the shell pipe 21 and enters the combustion chamber 18 through the flared flow guide 27 and the nozzle 26. Turbulent flow of the process air caused by the abrupt change in the directional flow path of the air is alleviated by the flared opening of the flow guide 27 and laminar air flow reestablished by the air passing through the vane guide 28. With the ring burner 23 retracted within the nozzle 26 to the position "$A_1$" it is protected from the direct heat in the combustion chamber 18. Also, the flow of process air through the nozzle passes around the ring burner 23 providing additional cooling for the burner. It will be appreciated that cooling of the nozzle can also be effected by moving the valve operating lever 47 from the position it occupies in FIG. 4 to a position displaced 180° therefrom. This, as previously mentioned, interrupts the flow of gas from the distribution pipe 44 to the nozzle and establishes an air flow path from the manifold 49 through the burner 23.

Servicing of the ring burner 23 is facilitated by moving the ring burner to a position "$B_2$" indicated by broken lines in FIG. 3. In the position "$B_2$" the burner is located outwardly of the nozzle 26 where the burner can be easily removed from the end of the flexible pipe 24. Movement of the burner into the position "$B_2$" is accomplished by lowering the pipe 22 to its lowermost position "B" as indicated by the broken line showing thereof in FIG. 3.

From the foregoing description of the invention, it is apparent that a simple and effective means has been provided for protection and replacement of the burner. The invention also sets forth a novel multipurpose shell burner which is used to serve in preheating or refractory drying and also for process air to the kiln combustion chamber.

The embodiments of the invention in which an exclusive property or privilege is claimed are defined as follows:

1. A shell mounted burner assembly for a rotary kiln having a combustion chamber;

a shell burner pipe projecting radially inwardly into the combustion chamber of the kiln;

a nozzle projecting outwardly of the interior of said shell burner pipe;

a ring burner supported within said nozzle for selective axial positioning;

a supply pipe extending from the exterior of the kiln into said shell burner pipe, said supply pipe being provided with a flexible inner end portion operatively connected to said ring burner, said supply pipe being selectively movable within said shell burner pipe to effect the positioning of said burner from a preheat forward position in said nozzle to a retracted position within said nozzle for process air mode of operation or to an advanced position externally of the nozzle;

a source of combustion gas connected to said supply pipe;

whereby the flexible end portion of said supply pipe facilitates the connection of the burner to the supply pipe without creating an abrupt change in the flow path of the combustion gas and said burner is positionable for operational purposes within said nozzle and to an extended position outwardly of the nozzle for servicing.

2. Apparatus according to claim 1 wherein said nozzle is disposed with its axis in a plane which is angularly displaced from the axis of said shell burner pipe; and said supply pipe is provided with a flexible inner end portion to which said burner is removably secured; and, a control pipe within said shell burner pipe, said control pipe extending from the exterior of the kiln inwardly to a point adjacent said nozzle to guidably receive and direct said supply pipe into operative position within the kiln, said control pipe having a curved inner end portion operable to direct the flexible end of said supply pipe into said nozzle;

whereby the flexible end portion of said supply pipe facilitates the connection of the burner to the supply pipe without creating an abrupt change in the flow path of the combustion gas.

3. Apparatus according to claim 2 wherein said shell pipe is connected to a source of process air which flows therethrough and through said nozzle around said burner to effect a cooling of said burner as the process air is being supplied to the combustion chamber; and, there is provided a vaned support means operatively arranged around the end of said flexible portion of said supply pipe which removably receives said burner, the vanes of said vane support engaging the interior of said nozzle to slidably support said burner, said vane support also serving to reestablish straight flow to the process air being supplied to the combustion chamber through the nozzle.

4. A method of supplying air and fuel to the combustion chamber of a rotary kiln in a direction parallel to the axis of the chamber from the exterior circumference of the kiln comprising the steps of:

inserting a shell burner pipe from the shell of the kiln into the combustion chamber;

providing the inner extending end of the shell burner pipe with a nozzle to project in a direction parallel to the axis of the combustion chamber;

supporting a ring burner within the nozzle for axial position movement relative to the nozzle;

inserting a supply pipe into the shell burner pipe from the shell of the kiln;

connecting the external end of the supply pipe to a source of combustion fuel;

connecting the burner to the inner end of the supply pipe to gradually change the path of flow of the combustion fuel at the end of the supply pipe adjacent to the burner;

connecting the shell burner pipe to a source of combustion air to flow the combustion air around the burner within the nozzle into the combustion chamber.

5. The method of preheating the combustion chamber of a rotary kiln according to claim 4 including the step of reducing the turbulence of the combustion air flow prior to the combustion air leaving the nozzle.

6. The method of preheating the combustion chamber of a rotary kiln according to claim 4 wherein the supporting of the burner within the nozzle permits the bodily movement of the burner from a preheat position in the nozzle to a retracted position therein or to an extended position outside of the nozzle within the combustion chamber.

7. The method according to claim 4 including the step of controlling the connection of the source of combustion fuel and the source of combustion air to the burner and shell burner pipe respectively so that combustion fuel to the burner can be interrupted and the source of combustion air connected to the burner selectively.

* * * * *